United States Patent [19]

Ciuci

[11] 4,089,481

[45] May 16, 1978

[54] DECORATIVE TOILET TISSUE ENCLOSURE

[76] Inventor: Richard W. Ciuci, 3 Marseilles Dr., Locust Valley, N.Y. 11560

[21] Appl. No.: 745,102

[22] Filed: Nov. 26, 1976

[51] Int. Cl.[2] ..... A47K 10/38; A47K 10/22

[52] U.S. Cl. ..... 242/55.53

[58] Field of Search ..... 242/55.53, 55.2, 55.3, 242/55.55, 55.42, 68; 312/39

[56] References Cited

U.S. PATENT DOCUMENTS

| | | | |
|---|---|---|---|
| 901,520 | 10/1908 | Burris | 242/55.53 |
| 2,462,776 | 2/1949 | Price | 242/55.53 X |
| 2,606,724 | 8/1952 | Hertz | 242/55.53 |
| 2,737,353 | 3/1956 | Banks, Jr. | 242/55.53 |
| 2,858,994 | 11/1958 | Sarro | 242/55.2 |
| 3,073,541 | 1/1963 | Layton et al. | 242/55.53 |

*Primary Examiner*—George F. Mautz

[57] ABSTRACT

An enclosure adapted to be mounted in a standard toilet tissue support of predetermined dimensions and receive a standard toilet tissue roll therein.

4 Claims, 10 Drawing Figures

DECORATIVE TOILET TISSUE ENCLOSURE

BACKGROUND OF THE INVENTION

Considerable amounts of money are spent today by the modern home owner and apartment dweller in decorating the bathroom and powder room to provide an attractive atmosphere having compatible color decor. Toilet tissue rolls for use in the bathroom and powder room are made available for sale in standard size and fixtures are provided, usually on the wall, in the room to receive such size and support the roll in a readily available position. The presence of the exposed standard toilet tissue roll in a prominent position frequently interferes with the decor of the room. In view of this, manufacturers have provided a variety of colors of toilet tissue in a variety of patterns. It has been impossible however to provide sufficient variety to universally satisfy all households.

SUMMARY OF THE INVENTION

An enclosure for receiving a standard toilet tissue roll therein having means for mounting it in the standard toilet tissue support so that the toilet tissue is not exposed to view and the enclosure can be selected or decorated in accordance with the decor of the room.

DETAILED DESCRIPTION OF THE PREFERRED EMBODIMENT

Figure 1:
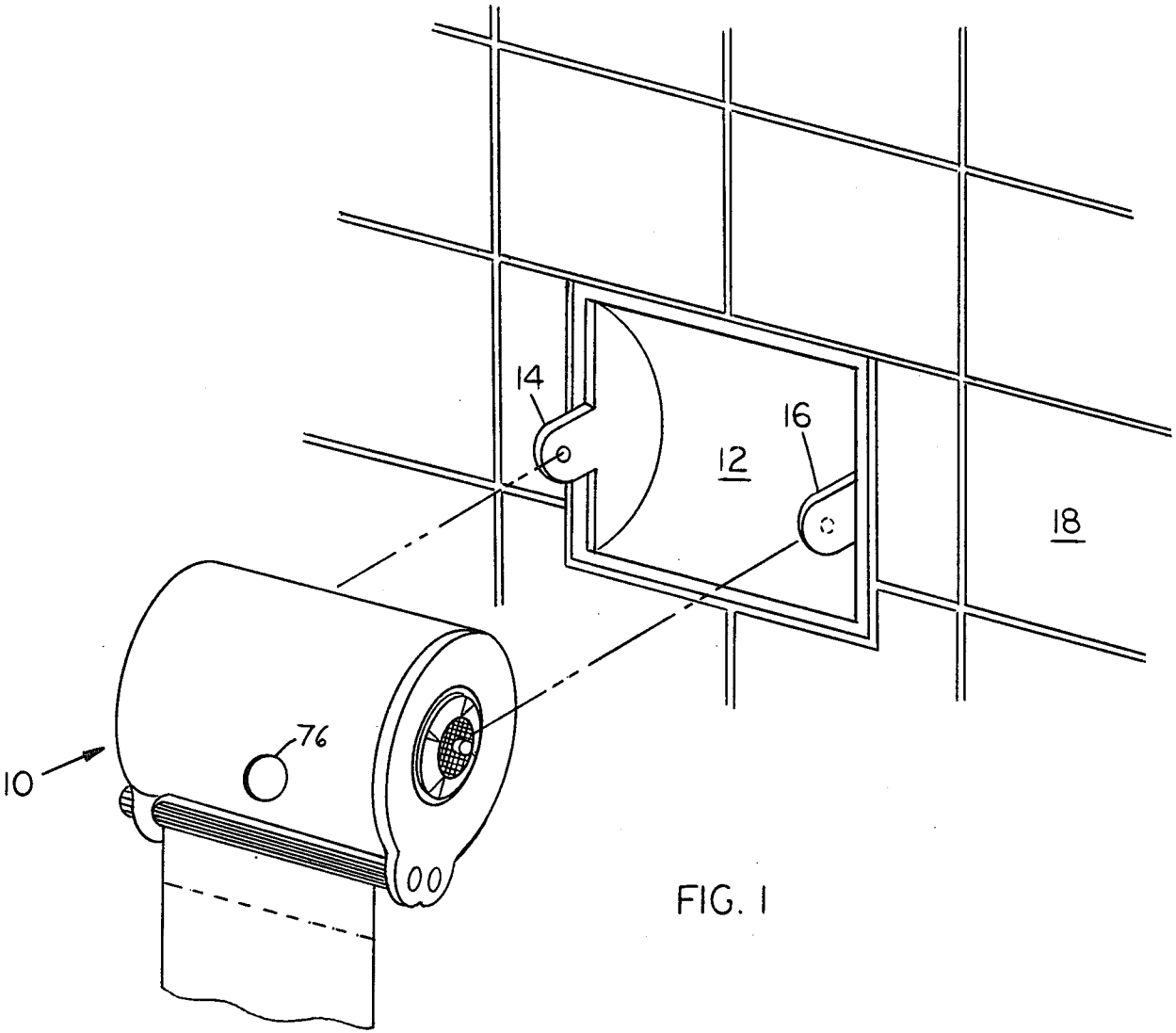
FIG. 1 is an exploded perspective view of the wall in a bathroom or powder room furnished with a standard toilet tissue support and a toilet tissue enclosure which is the subject of this invention provided for mounting in said support.
Figure 4:
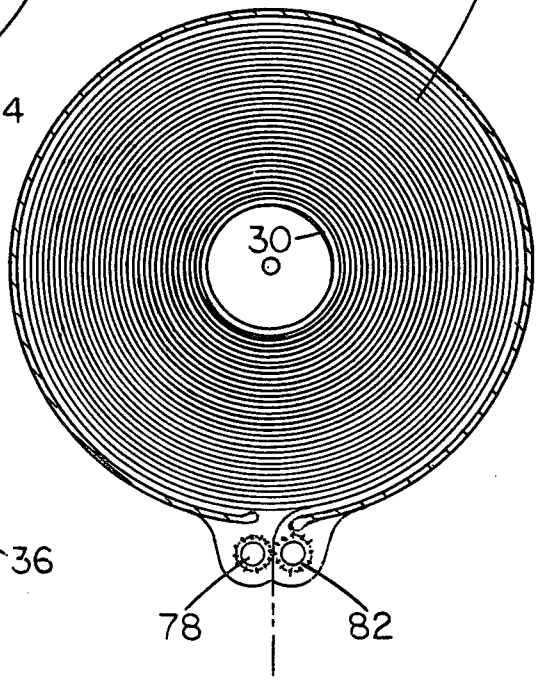
FIG. 4 is an end view of the enclosure similar to the view of FIG. 3 but with the enclosure cover removed.
Figure 2:
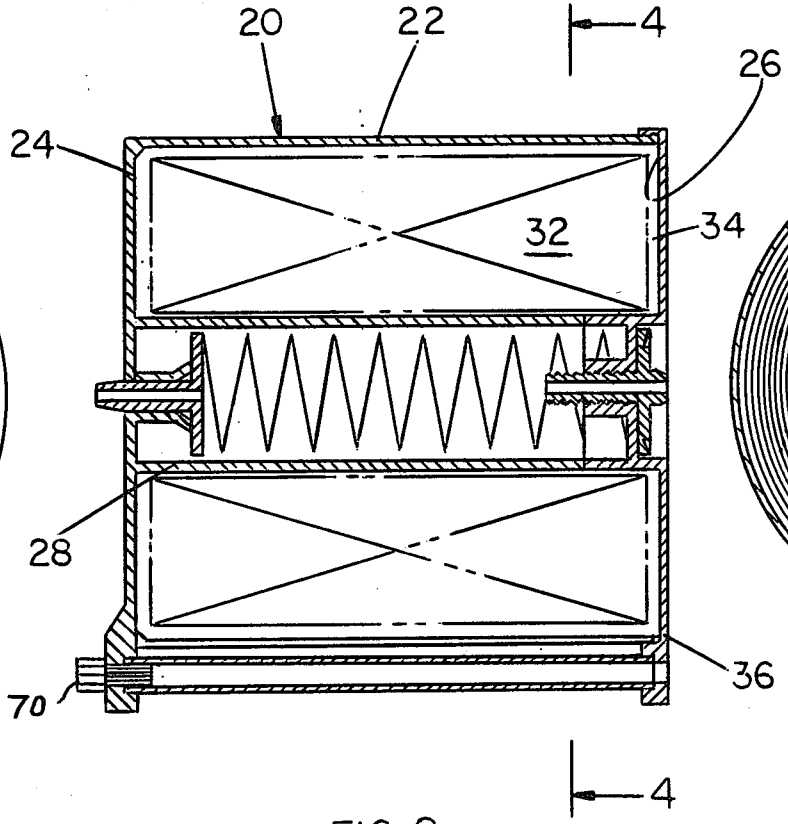
FIG. 2 is a longitudinal sectional view taken along the line 2—2 in the direction of the arrows in FIG. 3 illustrating the internal construction of the enclosure shown in FIG. 1.
Figure 3:
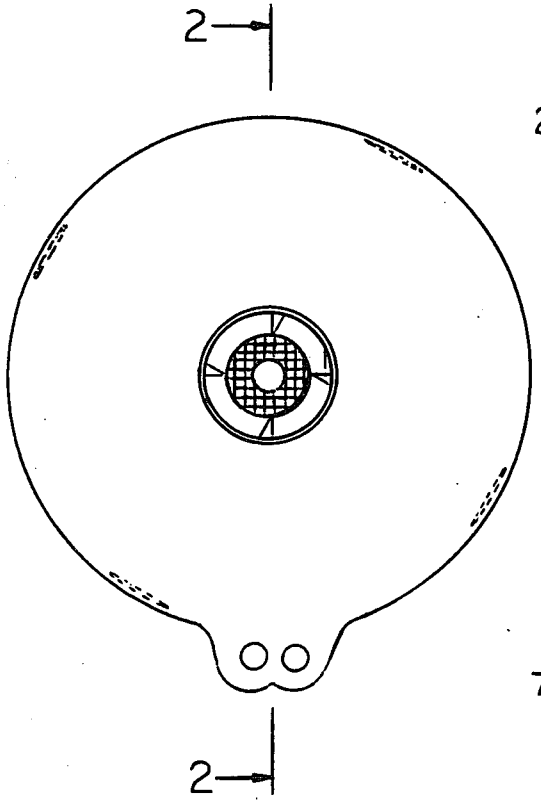
FIG. 3 is an end view of the enclosure as seen from the right in FIG. 2 with the enclosure cover affixed thereto.
Figure 5:
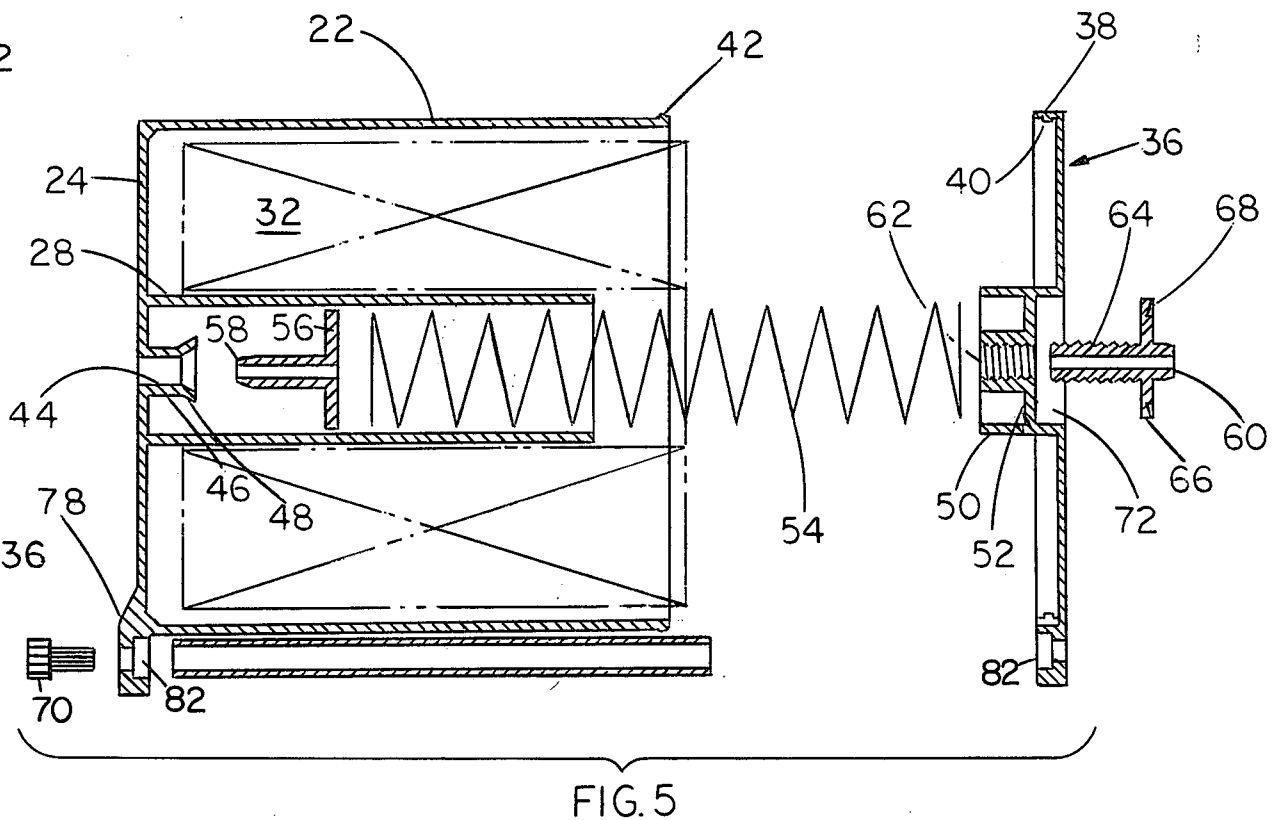
FIG. 5 is a view similar to that of FIG. 2 but with the parts in exploded position.
Figure 6:
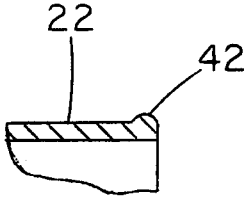
FIG. 6 is a segmentary view of the upper right corner of the enclosure as seen in FIG. 5 illustrating the outer peripheral fastening bead.
Figure 7:
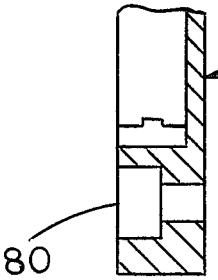
FIG. 7 is a segmentary view of the lower portion of the enclosure cover as seen in FIG. 5 illustrating the feed roll end support.
Figure 10:
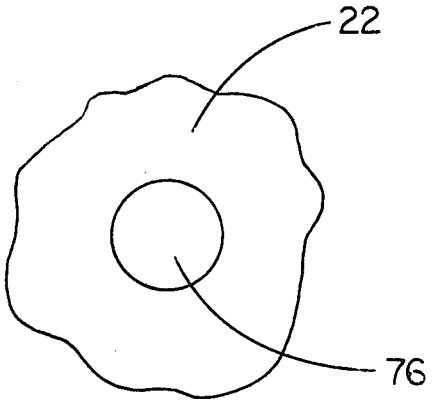
FIG. 10 is a segmentary view of a push slot.

A decorative toilet tissue constructed in accordance with the teachings of this invention is shown in the Figs. and indicated generally by the numeral 10. It is provided to be mounted in a toilet tissue support such as support 12 shown in FIG. 1 by mounting between arms 14 and 16 thereof which project outwardly therefrom with the support 12 embedded in wall 18 of a bathroom or powder room. Support 12 is a standard support of standard dimensions and of the type generally provided with the building installation.

The enclosure includes a hollow container 20 with a cylindrical outer wall 22, and end wall 24 and an open end 26. The container 20 can be plastic in the preferred embodiment or can be fabricated of any other suitable material. A hollow cylinder 28 within the container and concentric with wall 22 projects from the end wall 24. The dimensions are such that the outside diameter of cylinder 28 is less than the inside diameter of the core 30 of the toilet tissue roll 32 and the inside diameter of cylindrical wall 22 is greater than the outside diameter of a full toilet tissue roll 32. Cylinder 28 in the preferred embodiment is integral with the end wall 24 which itself is integral with the cylindrical outer wall 22. The outer wall 22 and the projecting cylinder 28 together form an annular compartment 34 for receipt of the toilet tissue roll 32. The assembly includes a cover 36 which is circular and has a projecting skirt 38 with inwardly annular bead 40 formed thereon so that it can cooperate with annular bead 42 formed on the edge of wall 22 at opening 26. The circumferential skirt and bead 40 cooperate therefore with peripheral bead 42 to provide a snap fit of the cover 36 on the outer wall 22. A central mounting aperture 44 is provided in wall 24 and a surrounding cylinder 46 with funnel end 48 projects inwardly therefrom. The cover 36 is provided with an inwardly projecting cylinder 50 similar in diameter to cylinder 28 within abutting surface 52 which receives an end of coil spring 54. The remaining end of the coil spring 54 abuts flange 56 of mounting pin 58 and in the assembled condition yieldingly urges the pin through aperture 44 exposing it for mounting purposes.

A second mounting pin 60 projects from the cover 36. A threaded insert 62 is provided in the cover for the purpose and the pin 60 is provided with threads 64 which are received in the threaded insert 62 whereby the distance the mounting pin 60 projects from the cover 36 is adjustable by screw adjustment. A flange 66 is provided on pin 60 with depressions in its outer surface to provide gripping serrations or raised portions 68 to enable the user to adjust the distance by which the pin 60 projects from the cover 36 and a flange receiving well 72 is provided in the cover to receive flange 66 when it is screwed to an appropriate distance to lock the container to arms 14 and 16 of FIG. 1.

Figure 9:
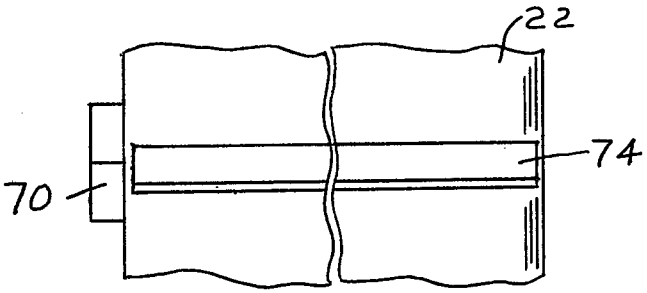
FIG. 9 is a segmentary view from below with rolls removed illustrating the tissue exit slot.

A tissue exit slot 74 is provided in outer wall 22 as shown in FIG. 9 so that toilet tissue within the container can be received outwardly thereof. To this end a push opening 76 can be provided giving access to the toilet tissue roll to rotate the same to feed paper.

Figure 8:
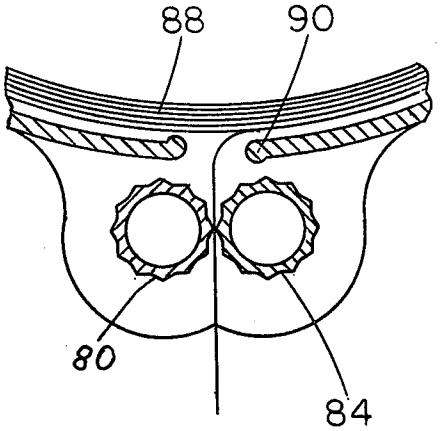
FIG. 8 is a segmentary view from the end of the enclosure illustrating the feed rolls.

Additionally, the end wall 24 and the cover 36 are provided with facing identical roll supports 78 formed therein for supporting feed roll 80 adjacent slot 74 and parallel thereto. Facing identical roll supports 82 are provided in the end wall 24 and cover 36 as well to support parallel serrated feed rub rolls one on either side of exit slot 74. These rolls are identical except that roll 84 is provided with an end knob making it the drive roll and roll 80 an idler. The edges of wall 22 at slot 74 are beaded edges as shown in FIG. 8 with the means identified by the numerals 88 and 90.

In using my invention the cover is removed and a roll of toilet tissue placed within container 20 by telescoping the tissue roll core over cylinder 28. At this time with it open an end of the toilet tissue 32 can be threaded through slot 74 if it is desired. Cover 36 is then placed in position and attached to wall 22 by a snap fit. With this operation spring 54 yieldingly urges pin 58 through aperture 44 for insertion in one of the arms 14 or 16. The pin 60 is rotated until it projects the proper distance from the cover 36 and it is received in the remaining arm of fixture 12. Under certain circumstances it may be desirable to insert pin 60 in the arm before insertion of pin 58. The precise sequence will be determined by consideration of the desire of the user and by the location of the fixture in the bathroom or powder room. The toilet tissue can then be threaded through opening 74 if it has not been threaded therethrough already by use of the push opening 76.

With this invention the toilet tissue is maintained within the enclosure and the enclosure can be decorated to maintain the decor of the bathroom or powder room. The enclosure wall 22 can be decorated by the purchaser or it can be purchased having a decorative surface already formed thereon so that the home owner is not dependent upon the toilet tissue manufacturer in selecting a decor for the room.

I claim:

1. A toilet tissue roll receiving enclosure mountable in a toilet tissue support including in combination a hollow container formed with an open end, an end wall providing a closed end, an outer cylindrical wall, a hollow cylinder projecting from said end wall concentrically with said outer wall, said hollow cylinder having an outside dimension less than the inside dimension of said toilet tissue roll so that said toilet tissue roll can be received therein within said outer wall, an enclosure cover receivable on said outer cylindrical wall for closing said container, a central mounting aperture in said end wall, a first mounting pin within said hollow cylindrical and projecting through said aperture, an abutting surface of said enclosure cover, spring means disposed between said abutting surface and said first mounting pin yieldingly urging said first mounting pin through said aperture, a second mounting pin projecting from said cover whereby said first and second mounting pins can be received in said toilet tissue support to mount said enclosure, an opening slot in said outer wall for receipt of toilet tissue from within said container, said second mounting pin being threaded and received within a threaded insert in said cover whereby the distance from said second mounting pin projects from said cover is adjustable by screw adjustment, said second mounting pin having a flange grip for screw adjustment thereof and said cover having a flange receiving well.

2. A toilet tissue roll receiving enclosure in accordance with claim 1 in which said cover has a circumferential skirt and said outer cylindrical wall is furnished with a peripheral bead for cooperation with said skirt to provide a snap fit of said cover on said outer wall.

3. A toilet tissue roll receiving enclosure in accordance with claim 1 in which a feed drive roll and a feed idler roll are supported on either side of said opening slot for feeding said paper therethrough.

4. A toilet tissue roll receiving enclosure in accordance with claim 3 in which said end wall and said cover are provided respectively with first and second feed roll end supports and the ends of said drive rolls are rotatably supported thereby.

* * * * *